US008480117B2

(12) United States Patent
Purdy

(10) Patent No.: US 8,480,117 B2
(45) Date of Patent: Jul. 9, 2013

(54) MOBILE, COLLAPSIBLE TABLE AND STORAGE ASSEMBLY

(76) Inventor: Chrissie Purdy, Camberwall (AU)

( * ) Notice: Subject to any disclaimer, the term of this patent is extended or adjusted under 35 U.S.C. 154(b) by 225 days.

(21) Appl. No.: 12/972,895

(22) Filed: Dec. 20, 2010

(65) Prior Publication Data

US 2012/0007342 A1 Jan. 12, 2012

(30) Foreign Application Priority Data

Jul. 8, 2010 (AU) ..... 2010202885

(51) Int. Cl.
*B62B 3/02* (2006.01)
*A47B 3/00* (2006.01)
*A47B 3/091* (2006.01)

(52) U.S. Cl.
CPC *A47B 3/00* (2013.01); *A47B 3/0911* (2013.01)
USPC ..... 280/651; 280/640; 280/47.26; 280/43.1; 280/47.131; 280/47.18; 280/638; 280/639

(58) Field of Classification Search
CPC ..... A47B 3/00; A47B 3/0911; B66F 3/12
USPC ..... 190/1, 10, 11, 12 R; 280/30, 651, 280/43.1, 47.18, 47.19, 47.26, 47.131, 49.3, 280/638, 639, 648; 312/249.12, 249.13, 312/281, 282, 313–316, 317.1, 317.3; 211/27, 211/85, 133.6, 190, 195
See application file for complete search history.

(56) References Cited

U.S. PATENT DOCUMENTS

| | | | | |
|---|---|---|---|---|
| 1,981,285 | A * | 11/1934 | Rechlicz | 248/421 |
| 2,805,110 | A * | 9/1957 | Carlbom | 108/91 |
| 3,989,225 | A * | 11/1976 | Keilholz | 254/126 |
| 4,093,182 | A * | 6/1978 | Rutenbeck | 254/126 |
| 4,289,300 | A * | 9/1981 | Weisser et al. | 254/126 |
| 6,471,236 | B1 * | 10/2002 | Eskridge | 280/648 |
| 6,491,318 | B1 * | 12/2002 | Galt et al. | 280/651 |
| 8,172,255 | B1 * | 5/2012 | Martin | 280/651 |

* cited by examiner

*Primary Examiner* — John R Olszewski
*Assistant Examiner* — Brian Cassidy

(57) ABSTRACT

A mobile, collapsible table and storage assembly for outdoor recreational use. The assembly includes: a storage compartment having a receptacle and lid, wheels at a first end of the storage compartment, a stand connected to the first end, a handle connected to the storage compartment at a second end, and folding legs connecting the receptacle and lid of the storage compartment. Each leg has a lower limb and an upper limb connected by a pivot, such that the limbs are movable between a folded and unfolded position. An end of one of the limbs at which the pivot is located has an extension portion which engages an adjacent end of the other limb to allow the lower and upper limbs to assume the unfolded position when forming an angle greater than 180 degrees. This prevents the table collapsing by buckling of the folding legs.

8 Claims, 11 Drawing Sheets

MOBILE, COLLAPSIBLE TABLE AND STORAGE ASSEMBLY

TECHNICAL FIELD

The present invention relates to a mobile, collapsible table and storage assembly. In particular, the present invention relates to an assembly for outdoor recreational use, such as at picnics, horse racing events and free entertainment in the parks, that is able to be transformed by the user between, in one instance, a wheeled storage compartment for foldable chairs and like recreational items and, in another instance, a table around which the chairs can be placed.

Although the background, objects and preferred embodiments of the invention will be hereinafter described with reference to a mobile, collapsible table and storage assembly for outdoor recreational use, it is to be understood that the invention is not limited thereto but has wider application. For example, the mobile, collapsible table and storage assembly may be used for indoor, constructional use, such as by tradesmen who require a work bench and a storage compartment for their tools within a building.

It is to be understood that the terminology employed herein is for the purpose of description only and should not be regarded as limiting. For instance, the terms "comprising" or "comprises" are to be understood as meaning "including", unless otherwise stated. Also, the term "table" is to be understood as including any structure, whether or not it is "table-like", upon which a user may support items and which may be collapsed upon a receptacle to form a storage compartment.

BACKGROUND ART

As society is becoming increasingly mobile through the greatly expanded use of cars, more and more families engage in outdoor recreational activities, such as picnics. While, often times, people will seek to use pre-existing picnic facilities, such as tables and benches at parks and other large open spaces, these are generally very popular and may be unavailable for use for long periods until vacated. Many people prefer to picnic by themselves in more natural surroundings where no pre-existing picnic facilities are available. Also, organized outdoor entertainment is often staged in parks where there may similarly be no permanent picnic facilities. These circumstances generally lead to the use of a picnic blanket or the like, which is uncomfortable and often untidy. Thus, there is a growing need for a portable informal dining facility for outdoor recreational use in a form that is compact, lightweight, easy to transport and able to provide a table and seating therefor.

Commonly, fold-up tables and fold-up chairs, along with thermally insulated containers (such as ESKIES) and picnic baskets, are carried to picnic sites, usually by several people or by a single person struggling to carry them all on one trip or more comfortably on several trips from their car. Attempts have been made to reduce this burden by providing collapsible table and bench assemblies which are a single, multiply foldable unit that, when collapsed, forms a hand held carry case. However, because it must be transported by hand, it cannot exceed a certain weight or size, and so has no or very limited storage capacity for any other picnic items.

It has been found by the present inventor that these problems can be overcome by providing a mobile, collapsible table and storage assembly for outdoor recreational use that is able to be transformed by the user between, in one instance, a wheeled storage compartment for foldable chairs and like recreational items and, in another instance, a table around which the chairs can be placed.

DISCLOSURE OF INVENTION

It is, therefore, an object of the present invention to overcome or substantially ameliorate the disadvantages and problems of the aforementioned prior art, or at least provide a useful alternative.

It has been found by the present inventor that these and other objects of the invention may be achieved in general by providing a mobile, collapsible table and storage assembly comprising:

(a) a storage compartment having a receptacle and a lid, (b) wheel means disposed at a first end of the storage compartment, (c) stand means connected to the first end which cooperate with the wheel means for supporting the assembly when in a generally upright position, (d) handle means connected to the storage compartment at a second end thereof, (e) a plurality of folding legs interconnecting the receptacle and the lid of the storage compartment, each leg comprising a lower limb and an upper limb interconnected by a pivot means, the lower and upper limbs of each leg being pivotally movable between a fully folded position where the lid closes the receptacle for use in storage, and a fully unfolded position where the lid is spaced apart from the receptacle for use as a table, characterized in that a floating end of a first one of the limbs at which the pivot means is located has an extension portion which is adapted to engage an adjacent floating end of a respective second one of the limbs so as to allow the lower and upper limbs to assume the fully unfolded position only when they have pivotally moved to an angle sufficiently greater than 180 degrees to prevent the so formed table collapsing by buckling of the folding legs through downward force on the pivot means.

Preferably, the first limb is the lower limb and the second limb is the upper limb. Alternatively, the first limb is the upper limb and the second limb is the lower limb.

It is preferred that the extension portion has a generally U-shaped cross section defining a cavity into which the adjacent floating end of the second limb engages.

In a preferred form, there are four folding legs, a first pair being located adjacent the first end of the storage compartment and a second pair being located adjacent the second end of the storage compartment, the lower and upper limbs of each one of the first pair being pivotally movable by folding in a direction towards the second end of the storage compartment when moving to the fully folded position, and the lower and upper limbs of each one of the second pair being pivotally movable by folding in a direction towards the first end of the storage compartment when moving to the fully folded position.

It is also preferred that the lower limb of each folding leg is generally channel shaped and its respective upper limb fits at least partly within the lower limb when the limbs have moved to the fully folded position.

Each of the folding legs preferably include a bottom pivot bracket and a top pivot bracket, the bottom pivot bracket being immovably mounted to the receptacle and the top pivot bracket being immovably mounted to the lid, and wherein the lower limb has a lower fixed end that is pivotally mounted to the bottom bracket and the upper limb has an upper fixed end that is pivotally mounted to the top bracket.

A pair of short, non-slip feet are preferably connected to the storage compartment at the second end thereof, and the feet cooperate with the wheel means for supporting the assembly when in an immobile, generally horizontal position.

In a further aspect of the invention, the stand means is adapted to receive an axle of the wheel means so as to form a wheel base stand. Such a wheel base stand may be bolted to the first end of the storage compartment.

In this aspect, the stand means may be formed of tubing or sheet material, and may be fabricated of metal, plastic or other material.

When formed of tubing, the tubing is generally U-shaped when viewed from the front, and is bent transversely to be generally L-shaped when viewed from the side, and has a pair of aligned apertures to receive the axle of the wheel means therethrough.

When formed of sheet material, the sheet material is bent transversely to be generally L-shaped when viewed from the side, and is curled over at one edge to receive the axle of the wheel means therethrough.

In a still further aspect of the invention, the assembly includes a divider within the receptacle, the divider being adapted to receive a thermally insulated container, such as a drinks cooler or insulated bag at one side thereof, and to receive foldable chairs or like recreational items at the other side thereof.

Preferably, the divider includes channel portions into which frame members of foldable chairs are received, the channel portions being located remotely of the folding legs so that the so received foldable chairs do not interfere with the pivotal movement of the lower and upper limbs of each folding leg.

In this aspect, the divider may be fabricated of metal, plastic or other material, and may be permanently attached to the receptacle.

There has been thus outlined, rather broadly, the more important features of the invention in order that the detailed description thereof that follows may be better understood and put into practical effect, and in order that the present contribution to the art may be better appreciated.

There are additional features of the invention that will be described hereinafter. As such, those skilled in the art will appreciate that the conception, upon which the disclosure is based, may be readily utilized as the basis for designing other assemblies and processes for carrying out the objects of the present invention. It is important, therefore, that the broad outline of the invention described above be regarded as including such equivalent constructions in so far as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the accompanying drawings, in which.

MODES FOR CARRYING OUT THE INVENTION

Figure 1:
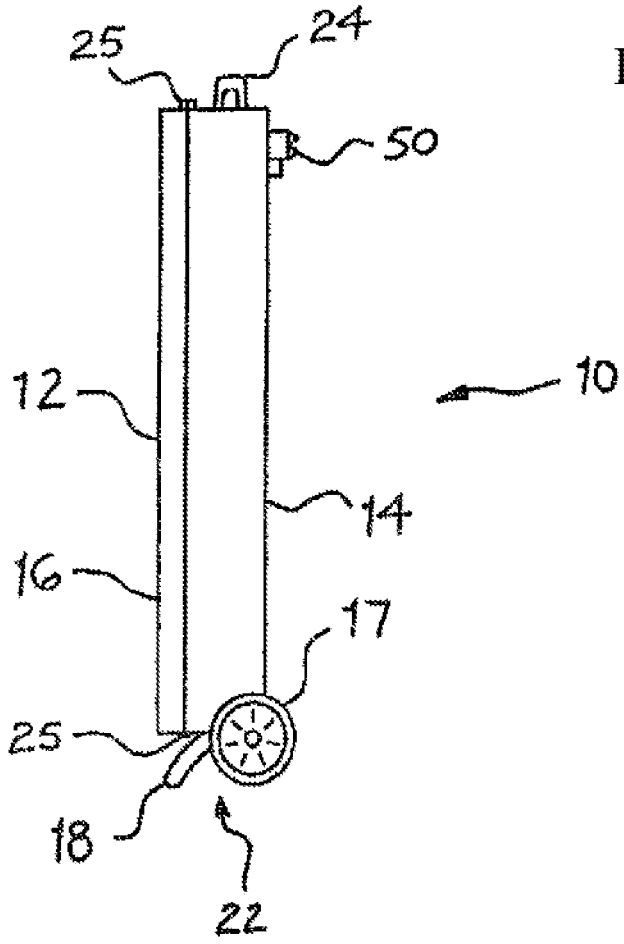
FIG. 1 is a side view of a mobile, collapsible table and storage assembly according to a preferred embodiment of the invention, when in a generally upright position.

With reference now to the above summarized drawings of FIGS. 1 to 11, a mobile, collapsible table and storage assembly embodying the principles and concepts of the present invention and generally designated by the reference numeral 10 will now be described.

The assembly 10 includes a storage compartment or case 12 having a receptacle or base 14 and a lid 16. A pair of wheels 17 and a stand member 18 are interconnected by an axle 20 received by the stand member 18 so as to form a wheel base stand 22 which is bolted as a single piece to the receptacle 14 at a first end of the case 12. The wheel base stand 22 can support the assembly 10 when in a generally upright position. The assembly 10 also has a handle 24 connected to the receptacle 14 at a second end of the case 12, and opposed closure clips 25 for firmly closing the lid 16 on the receptacle 14.

Figure 2:
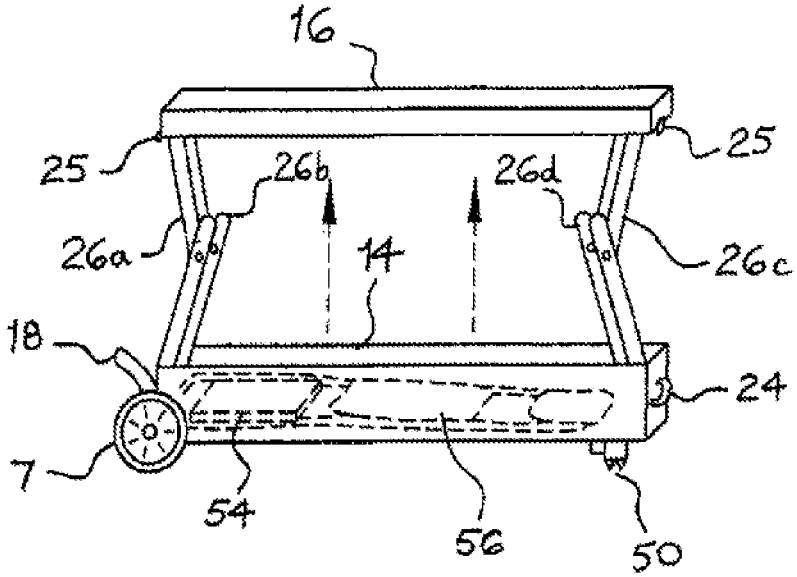
FIG. 2 is a side view of the assembly of FIG. 1 when in a generally horizontal position, and in the course of being expanded to a fully unfolded position.
Figure 3:
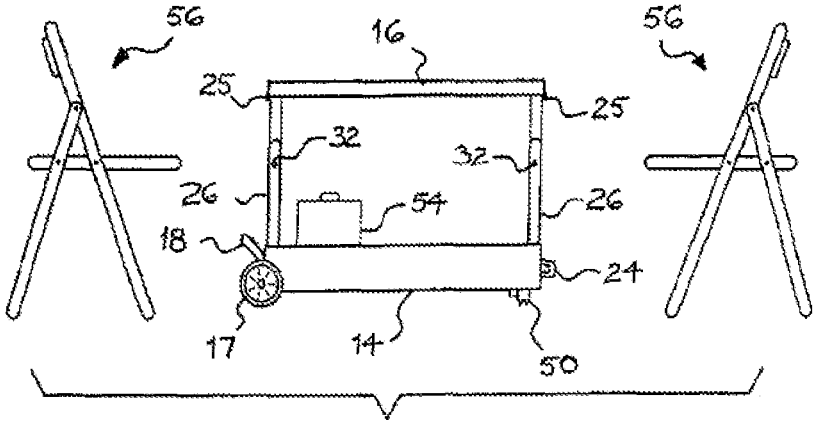
FIG. 3 is a side view of the assembly of FIG. 2 when in the fully unfolded position where the lid is spaced apart from the receptacle for use as a table, and of a pair of foldable chairs that were stored therein that are now unfolded and placed beside the table.
Figure 5:
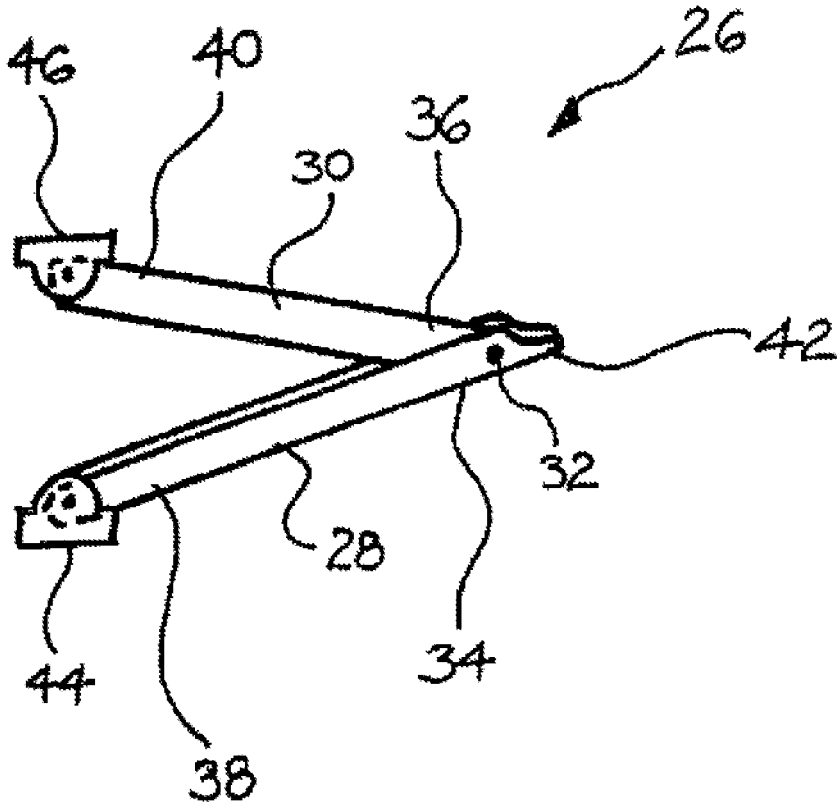
FIG. 5 is an isolated side view of a folding leg of the assembly of FIGS. 1 to 4, the folding leg interconnecting the receptacle and the lid of the storage compartment (not shown), and being shown in an early stage of being expanded to a fully unfolded position.
Figure 6:
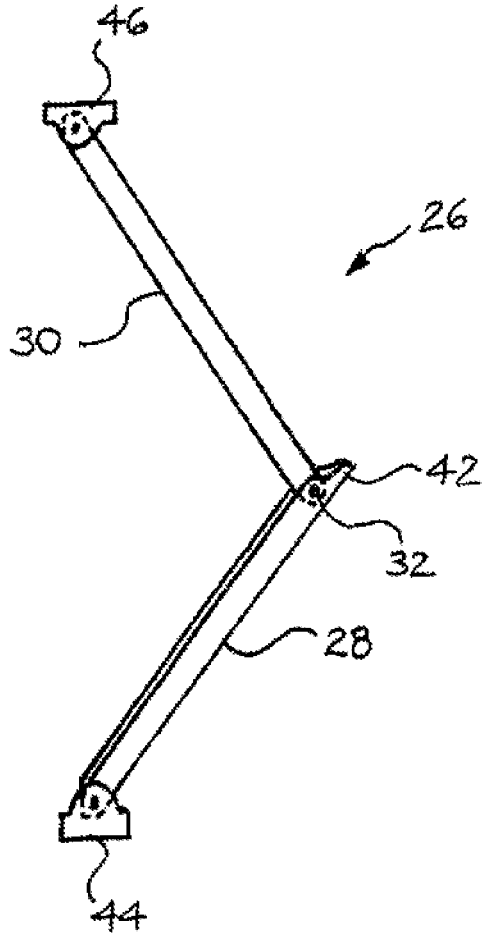
FIG. 6 is an isolated side view of the folding leg of FIG. 5 shown in an intermediate stage of being expanded to a fully unfolded position.
Figure 7:
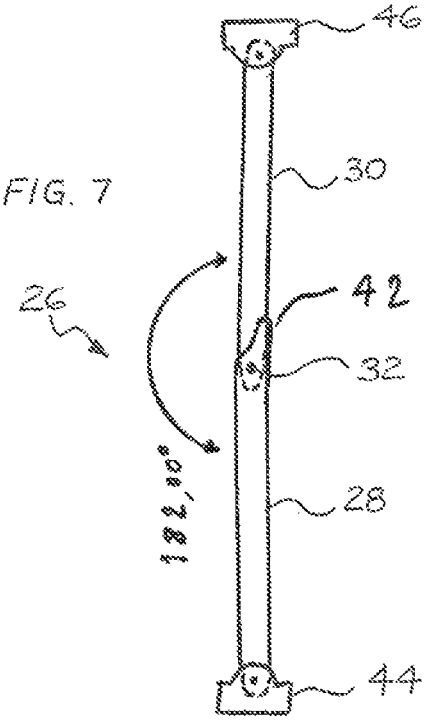
FIG. 7 is an isolated side view of the folding leg of FIG. 6 shown in a final stage after having been expanded to a fully unfolded position where the lid is spaced apart from the receptacle for use as a table, and showing the upper limb of the folding leg in an over-centre position with reference to the lower limb, the over-centre position corresponding to an angle sufficiently greater than 180 degrees to prevent the so formed table collapsing by buckling of the folding legs.

The collapsible feature of the assembly 10 is provided by four folding legs 26 interconnecting the receptacle 14 and the lid 16 of the case 12. A first pair of folding legs 26*a*, 26*b* are located adjacent the first end of the case and a second pair of folding legs 26*c*, 26*d* are located adjacent the second end of the case. Each leg 26 has a lower limb 28 and an upper limb 30 interconnected by a pivot pin 32. The lower and upper limbs 28, 30 of each leg 26 are pivotally movable (as shown in FIG. 2) between a fully folded position where the lid 16 closes the receptacle 14 to form the case (as shown in FIG. 1) for use in storage, and a fully unfolded position where the lid 16 is spaced apart from the receptacle 14 to form the table (as shown in FIG. 3). The lower and upper limbs 28, 30 of each one of the first pair of legs are pivotally movable by folding in a direction towards the second end of the case 12 when moving to the fully folded position, and the lower and upper limbs 28, 30 of each one of the second pair of legs are pivotally movable by folding in a direction towards the first end of the case 12 when moving to the fully folded position. As shown in FIGS. 5 to 7, each limb 28, 30 has a floating end 34, 36 at which the pivot pin 32 is located and has a fixed end 38, 40 pivotally mounted by a respective fixed bracket 44, 46 to the receptacle 14 and lid 16 respectively. In this embodiment, the lower limb 28 has, at its floating end 34, an extension portion 42 which has a generally U-shaped cross section defining a cavity into which the adjacent floating end 36 of the upper limb 30 can engage so as to allow the lower and upper limbs 28, 30 to assume the fully unfolded position only when they have pivotally moved to an angle sufficiently greater than 180 degrees to prevent the so formed table collapsing by buckling of the folding legs 26 through downward force on the pivot pin 32. That angle is achieved when the upper limb 30 of the folding leg 26 is in an over-centre position with reference to the lower limb 28. The lower limb 28 of each folding leg 26 is generally channel shaped and its respective upper limb 30 fits within the lower limb when the limbs have moved to the fully folded position.

The aforementioned fixed brackets are, in this embodiment, a bottom pivot bracket 44 and a top pivot bracket 46. The bottom pivot bracket 44 is immovably mounted or fixed to the receptacle 14 and the top pivot bracket 46 is immovably mounted or fixed to the lid 16. The lower limb 28 has its lower fixed end 38 pivotally mounted to the bottom bracket 44 and the upper limb 30 has its upper fixed end 40 pivotally mounted to the top bracket 46.

Figure 4:
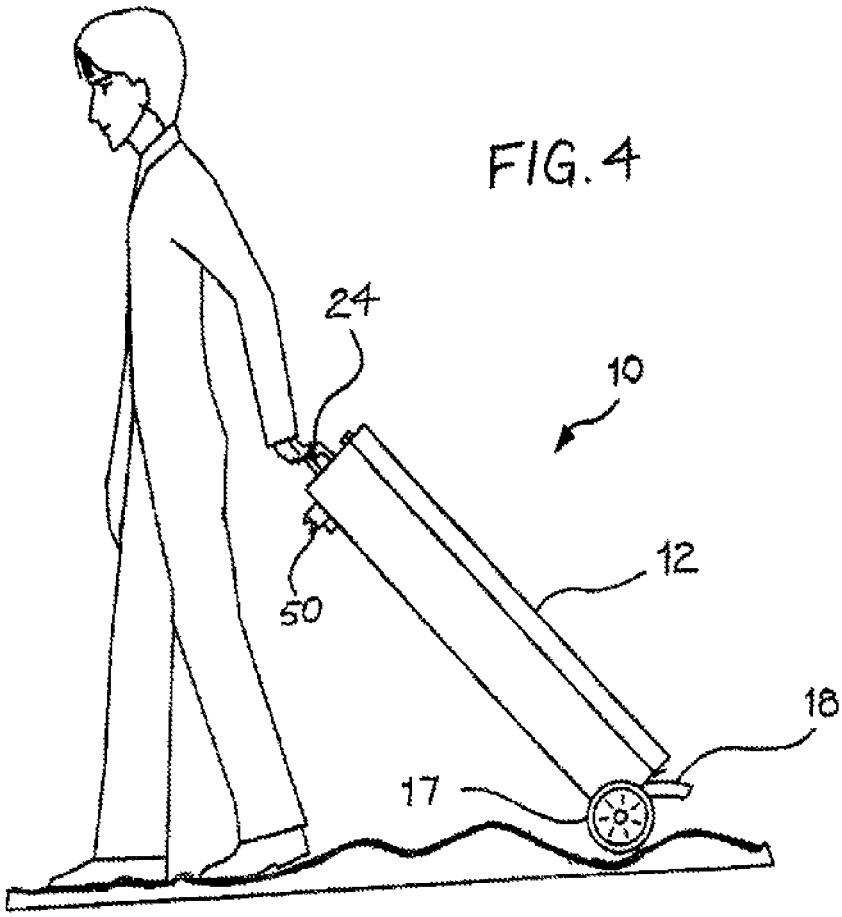
FIG. 4 is a side view of a user of the assembly of FIGS. 1 to 3 rolling the assembly, when in a fully folded position over undulating ground.

The collapsed assembly 10 is supported when in an immobile, generally horizontal position (say, prior to expansion of the assembly to form a table) by a pair of short, non-slip feet 50, which are connected to the case 12 at the second end thereof, and by the wheels 17. When it is desired to transport the collapsed assembly 10, say, over undulating ground, a user grips the handle 24 and rolls the assembly on its wheels 17, as shown in FIG. 4.

Figure 8:
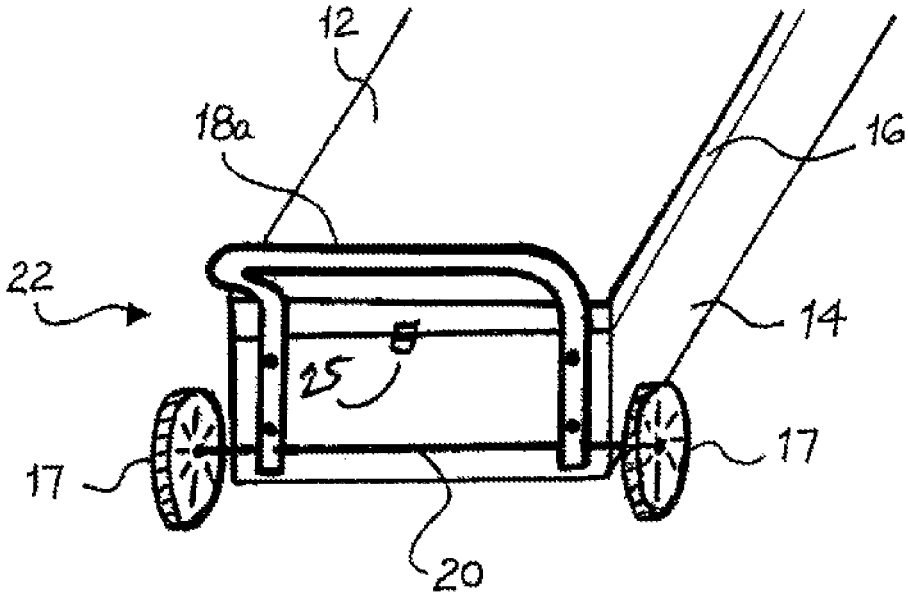
FIG. 8 is a perspective view of the first end of the storage compartment of the assembly of FIGS. 1 to 4 showing a first preferred wheel base stand formed of metal tubing bolted to the storage compartment.

The aforementioned stand member 18 (see FIG. 2) is, in the embodiment shown in FIG. 8, formed of metal tubing as shown at 18*a*. The tubing is generally U-shaped when viewed from the front, and is bent transversely to be generally L-shaped when viewed from the side. The tubing 18 a is sufficiently large in diameter to have a pair of aligned apertures top receive the axle 20 of the wheels 17 therethrough.

Figure 9:
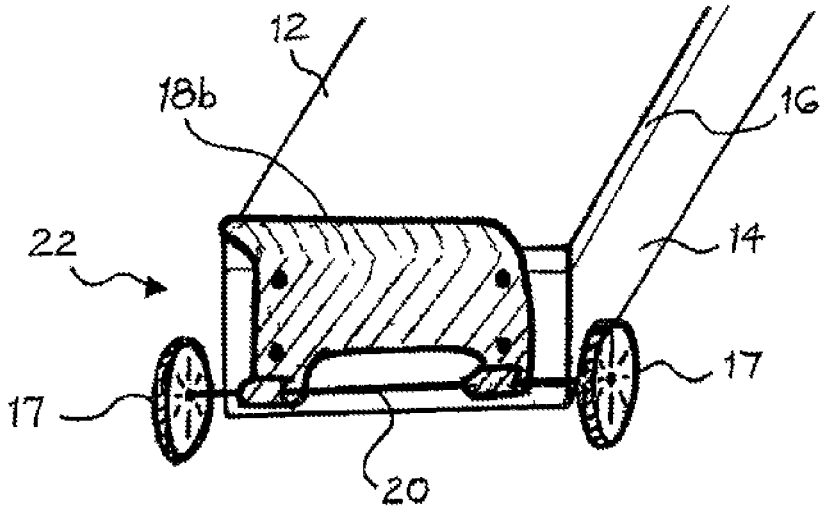
FIG. 9 is a perspective view of the first end of the storage compartment of the assembly of FIGS. 1 to 4 showing a second preferred wheel base stand formed of metal sheet material bolted to the storage compartment.
Figure 10:
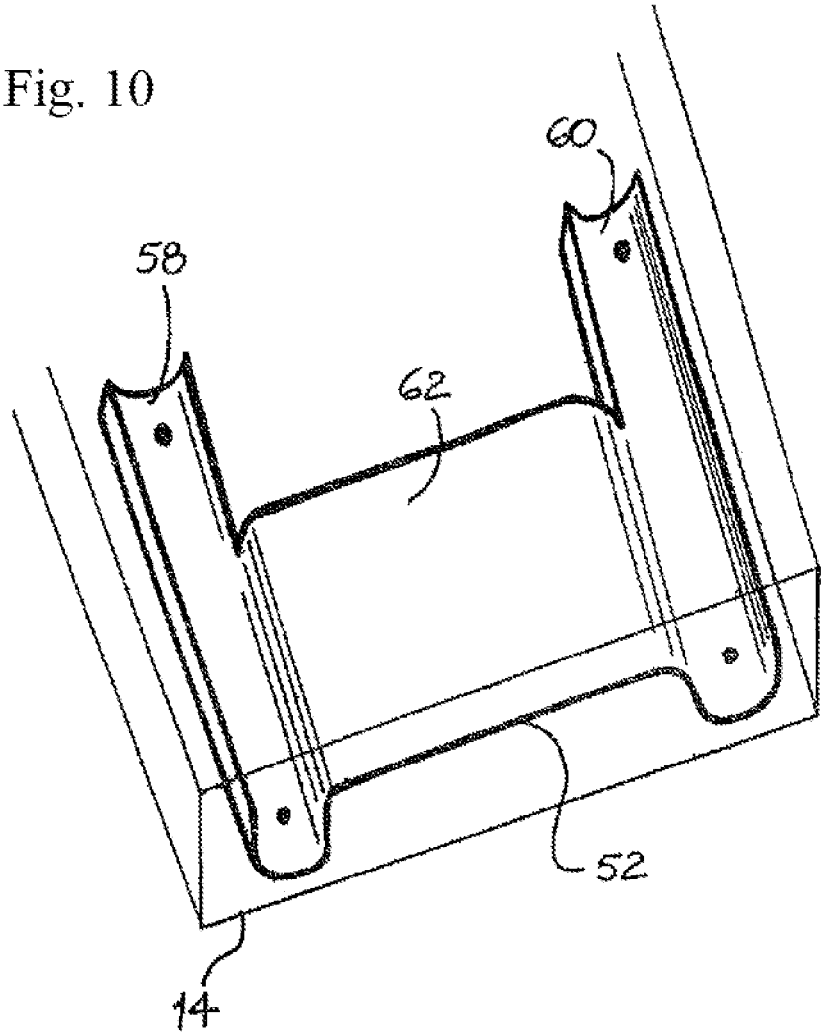
FIG. 10 is a perspective view of a divider located within the receptacle of the assembly of FIGS. 1 to 9.
Figure 11:
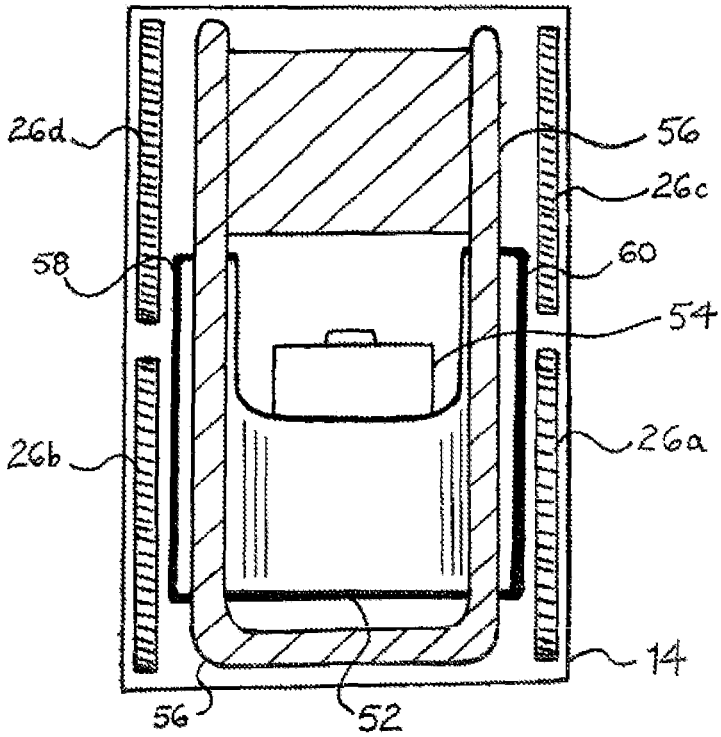
FIG. 11 is a top view of the divider shown in FIG. 10 when in use receiving a thermally insulated container at one side thereof, and receiving foldable chairs at the other side thereof.

In the embodiment shown in FIG. 9, the aforementioned stand member 18 is formed of sheet metal as shown at 18*b*. The sheet metal 18*b* is bent transversely to be generally L-shaped when viewed from the side, and is curled over at one edge to receive the axle 20 of the heels 17 therethrough.

The assembly 10 also has a plastic divider 52 (see FIGS. 10 and 11) permanently attached to the floor of the receptacle 14. In this embodiment, the divider 52 is adapted to receive a drinks cooler 54 at a lower side thereof and to receive foldable chairs 56 at an upper side thereof. The divider 52 has a pair of channel portions 58, 60 into which frame members of the foldable chairs 56 are compactly received. The channel portions 58, 60 are located remotely of the folding legs 26 so that the so received foldable chairs 56 do not interfere with the pivotal movement of the lower and upper limbs 28, 30 of each folding leg. The divider 52 also has an elevated portion 62 between the channel portions 58, 60 under which the drinks cooler 54 is compactly placed.

It will be apparent to persons skilled in the art that the mobile, collapsible table and storage assembly of the present invention may be made of many suitable materials.

It will be readily apparent from the above that there are various advantages of the present invention.

One advantage is that a user of the mobile, collapsible table and storage assembly of the present invention is provided with a portable informal dining facility for outdoor recreational use in a form that is compact, lightweight, easy to transport and able to provide a table and seating therefor.

Another advantage is that the assembly is able to be transported to picnic sites by a single person comfortably on a single trip from their car, and can be transformed by that person between, in one instance, a wheeled case or storage compartment for foldable chairs and like recreational items and, in another instance, a table around which the chairs can be placed.

Still further advantages of the present invention will be apparent to persons skilled in the art.

It will also be readily apparent to persons skilled in the art that various modifications may be made in details of design and construction of the embodiments of the mobile, collapsible table and storage assembly, and in the steps of using the assembly described above, without departing from the scope or ambit of the present invention.

The reference in this specification to any prior publication (or information derived from it), or to any matter which is known, is not, and should not be taken as an acknowledgement or admission or any form of suggestion that that prior publication (or information derived from it) or known matter forms part of the common general knowledge in the field of endeavour to which this specification relates before the filing date of this patent application.

What is claimed:

1. A mobile, collapsible table and storage assembly comprising: (a) a storage compartment having a receptacle and a lid, (b) wheel means disposed at a first end of the storage compartment, (c) stand means connected to the first end which cooperate with the wheel means for supporting the assembly when in a generally upright position, (d) handle means connected to the storage compartment at a second end thereof, (e) a plurality of folding legs interconnecting the receptacle and the lid of the storage compartment, each leg comprising a lower limb and an upper limb interconnected by a pivot means, the lower and upper limbs of each leg being pivotally movable between a fully folded position where the lid closes the receptacle for use in storage, and a fully unfolded position where the lid is spaced apart from the receptacle for use as a table, characterized in that a floating end of one of the upper or lower limbs at which the pivot means is located has an extension portion which is adapted to engage an adjacent floating end of the other limb so as to allow the lower and upper limbs to assume the fully unfolded position only when they have pivotally moved to an angle sufficiently greater than 180 degrees to prevent the so formed table collapsing by buckling of the folding legs through downward force on the pivot means, wherein the extension portion has a generally U-shaped cross section defining a cavity into which the adjacent floating end of the second limb engages.

2. The table and storage assembly according to claim 1 including four folding legs, a first pair being located adjacent the first end of the storage compartment and a second pair being located adjacent the second end of the storage compartment, the lower and upper limbs of each one of the first pair being pivotally movable by folding in a direction towards the second end of the storage compartment when moving to the fully folded position, and the lower and upper limbs of each one of the second pair being pivotally movable by folding in a direction towards the first end of the storage compartment when moving to the fully folded position.

3. The table and storage assembly according to claim 1 wherein the lower limb of each folding leg is generally channel shaped and its respective upper limb fits at least partly within the lower limb when the limbs have moved to the fully folded position.

4. The table and storage assembly according to claim 1 wherein each of the folding legs include a bottom pivot bracket and a top pivot bracket, the bottom pivot bracket being immovably mounted to the receptacle and the top pivot bracket being immovably mounted to the lid, and wherein the lower limb has a lower fixed end that is pivotally mounted to the bottom bracket and the upper limb has an upper fixed end that is pivotally mounted to the top bracket.

5. The table and storage assembly according to claim 1 including a pair of short, non-slip feet connected to the storage compartment at the second end thereof, and the feet cooperate with the wheel means for supporting the assembly when in an immobile, generally horizontal position.

6. The table and storage assembly according to claim 1 wherein the stand means is adapted to receive an axle of the wheel means so as to form a wheel base stand.

7. The table and storage assembly according to claim 1 wherein the assembly includes a divider within the receptacle, the divider being adapted to receive a thermally insulated container at one side thereof, and to receive foldable chairs or other recreational items at the other side thereof.

8. The table and storage assembly according to claim 7 wherein the divider includes channel portions into which frame members of foldable chairs are received, the channel portions being located remotely of the folding legs so that the so received foldable chairs do not interfere with the pivotal movement of the lower and upper limbs of each folding leg.

* * * * *